US010323843B2

(12) United States Patent
Pizarro

(10) Patent No.: US 10,323,843 B2
(45) Date of Patent: Jun. 18, 2019

(54) BURNER FOR VENT GASES OF AN OIL OR GAS WELL

(71) Applicant: Alto Comahue S.R.L., Cuidad de Neuquen (AR)

(72) Inventor: Oscar Carlos Pizarro, Cuidad de Cipolleti (AR)

(73) Assignee: ECO SAFE S.R.L., Provinac de Neuqen (AR)

( * ) Notice: Subject to any disclaimer, the term of this patent is extended or adjusted under 35 U.S.C. 154(b) by 162 days.

(21) Appl. No.: 15/633,862

(22) Filed: Jun. 27, 2017

(65) Prior Publication Data

US 2018/0003381 A1 Jan. 4, 2018

(30) Foreign Application Priority Data

Jul. 1, 2016 (AR) ..... P20160102018

(51) Int. Cl.

| | |
|---|---|
| ***F23G 7/06*** | (2006.01) |
| ***F23D 14/48*** | (2006.01) |
| ***F23D 14/62*** | (2006.01) |
| ***F23G 5/34*** | (2006.01) |
| ***F23Q 9/00*** | (2006.01) |

(52) U.S. Cl.

CPC ..... *F23G 7/06* (2013.01); *F23D 14/48* (2013.01); *F23D 14/62* (2013.01); *F23G 5/34* (2013.01); *F23Q 9/00* (2013.01); *F23G 2209/14* (2013.01)

(58) Field of Classification Search

CPC . F23D 14/48; F23D 14/62; F23G 7/06; F23G 5/34; F23G 2209/14; F23Q 9/00

See application file for complete search history.

(56) References Cited

U.S. PATENT DOCUMENTS

| | | | | |
|---|---|---|---|---|
| 2,779,399 A * | 1/1957 | Zink | F23G 7/08 | 422/172 |
| 4,854,855 A * | 8/1989 | Rajewski | F23G 7/085 | 431/202 |
| 6,345,979 B1 * | 2/2002 | Taylor | F23Q 9/00 | 431/266 |
| 8,096,803 B2 * | 1/2012 | Mashhour | F23L 17/16 | 110/344 |

* cited by examiner

*Primary Examiner* — Alfred Basichas

(74) *Attorney, Agent, or Firm* — Defillo & Associates, Inc.; Evelyn A. Defillo

(57) ABSTRACT

A burner for venting gas of a gas or oil well, the same comprises a venting gas tubing laid from the well up to a burning pit; a tubing for the supply of pilot gas laid parallel to the tubing of venting gas; a tubing of power lines from a control panel up to at least one electrode; a nozzle constituted by a tube that comprises a plurality of perforations that go through the wall of said tube, a plurality of air inlet tubes affixed to the wall of said tube; and a plurality of support spoilers affixed to the wall of said tube; where, the distal ends of the venting gas tubing, the tubing of supply of pilot gas and at the least one electrode, are located inside the nozzle; and where, the nozzle is installed inside the burning pit.

10 Claims, 3 Drawing Sheets

BURNER FOR VENT GASES OF AN OIL OR GAS WELL

FIELD OF THE INVENTION

The present invention refers to the field of the oil and gas industries, particularly with the equipment related to venting of wells, more particularly with the burning of gas from oil or gas wells.

STATE OF THE ART

During the proceedings of drilling of oil wells, remediation and intervention performing an important maintenance or correcting treatments in an oil or gas well ("workover"), finishing of wells done with equipment or support structures without drilling equipment ("rig-less"), etc., it is normal that evolutions of gas from the well to be produced, which must be taken care of by means of their burning.

Such gas combustion is done in pits which are separate from de well by means of a safe distance in order to avoid accidents.

However, since some time ago and nowadays, the lighting of the burning pits that are used in the oil and gas industries is done leaving a container that holds some type of lit fuel, for example gas oil, so when after the venting valve is opened, the gas is lit.

Another way, even more risky, that is used is to throw a piece of a burning cloth or burlap in the burning pit when the gas vents.

These two usual ways of lighting imply high risk for the people in charge of said tasks.

Due to the abovementioned, it is necessary to have safe and reliable equipment to light the gas during a venting in a burning pit in oil or gas wells in an effective and safe manner for the location and personnel involved.

SUMMARY OF THE INVENTION

Therefore, the object of the present invention is a burner for venting gas of a gas or oil well that comprises:

a venting gas tubing laid from the well up to a burning pit;

a tubing for the supply of pilot gas laid parallel to the tubing of venting gas;

a tubing of power lines from a control panel up to at least one electrode;

a nozzle constituted by a tube that comprises:

a plurality of perforations that go through the wall of said tube, a plurality of air inlet tubes affixed to the wall of said tube; and a plurality of support spoilers affixed to the wall of said tube;

where, the distal ends of the venting gas tubing, the tubing of supply of pilot gas and at the least one electrode, are located inside the nozzle; and where, the nozzle is installed inside the burning pit.

Preferably, the at least one electrode closes circuit with the venting gas tubing or the tubing that supplies pilot gas, grounded.

Alternatively, the at least one electrode closes circuit with another grounded electrode.

Also preferably, the electrodes are isolated from the metallic parts of the burner with ceramic.

In a preferred embodiment, the lighting of the burner is carried out by means of high frequency spark or high voltage spark.

In another preferred embodiment, the plurality of perforations that go through the wall of the tube of the nozzle are arranged in four symmetrical lines.

In even another preferred embodiment, the plurality of air inlet tubes affixed to the wall of the tube of the nozzle are four in number and are fixed at 45 degrees of the axis of the nozzle in its proximal end.

Preferably, the plurality of support spoilers affixed externally and longitudinally to the wall of the tube of the nozzle, are fixed at 90 degrees with respect to said tube and in an alternate and symmetrical way in relation to said perforations.

Especially, the venting gas tubing internal to the burner that fits in the burning pit vents gas from a production or test well stemming from a gas separator or from a test pool kicker.

Additionally, the burner counts with a venting line laid at the side of the burner and fitting in the burning pit venting gas from a well being drilled.

DETAILED DESCRIPTION OF THE INVENTION

Figure 1:
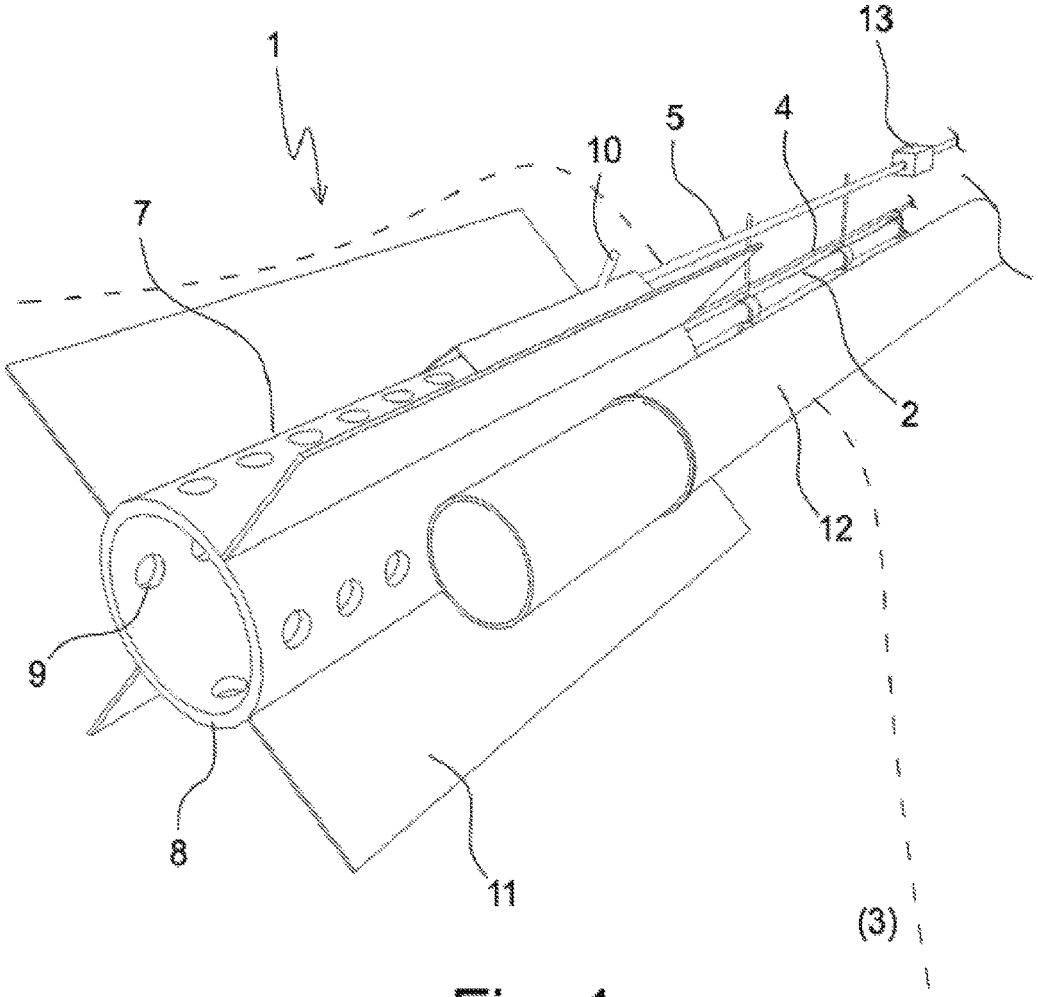
FIG. 1 is a view in perspective of a preferred embodiment of the burner for venting gas from an oil or gas well within a burning pit.
Figure 2A:
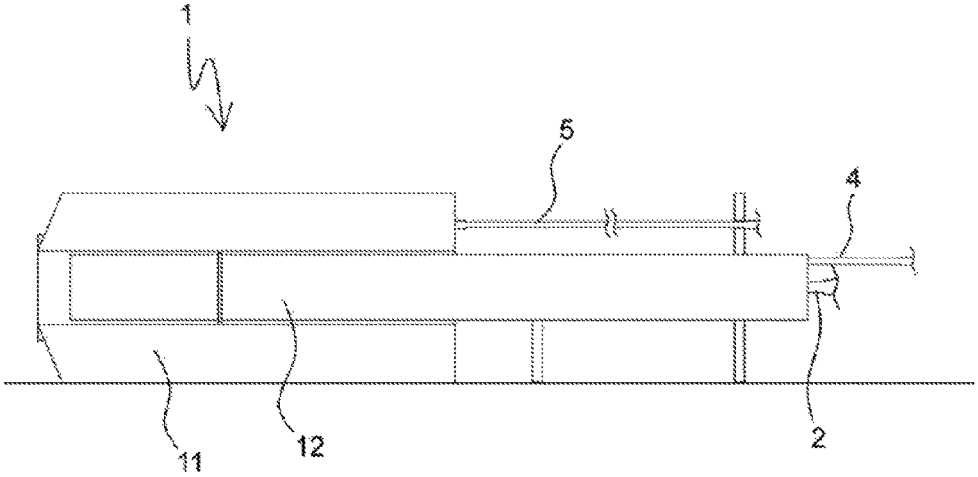
FIG. 2*a* is a lateral view of the burner for venting gases according to FIG. 1.
Figure 2B:
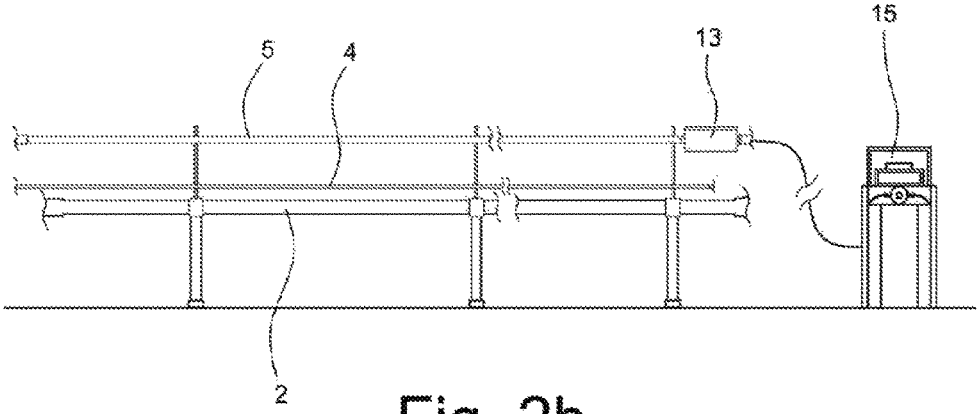
FIG. 2*b* is a lateral view of the supply lines of the different tubes that arrive to the burner for venting gases of FIG. 2*a;*
Figure 3:
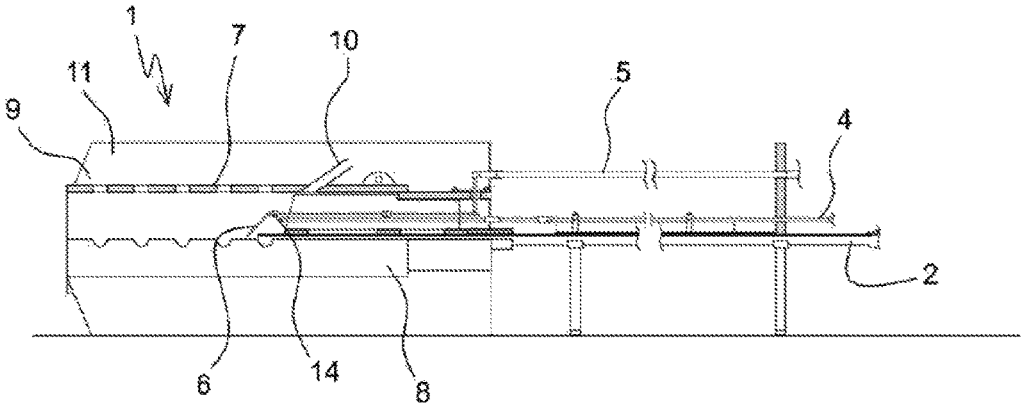
FIG. 3 is a lateral view of the burner according to FIG. 2 with an "L" section showing internal details.
Figure 4:
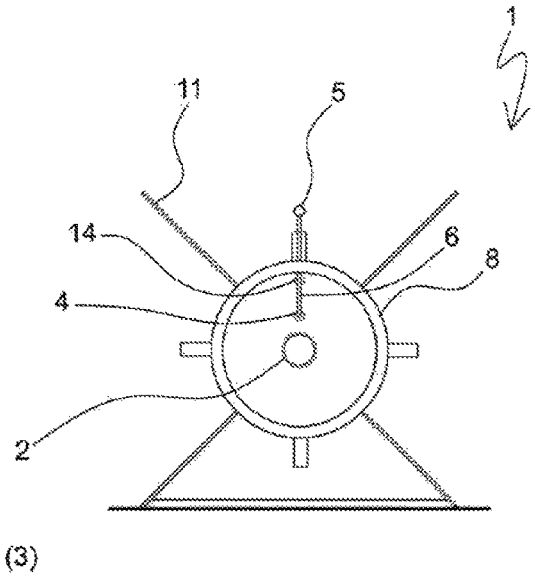
FIG. 4 is a front view of the burner for venting gases according to FIG. 2.

The present invention is related to a burner to light venting gas at a distance by means of a pulsator that produces an electrical arch (spark) by means of an electrical current, thus nullify any possibility of accidents.

Said pulsator is positioned at a distance of 50 meters or more from the burning pit, thus making the operation secure for the people involved.

Furthermore, the burner of the present invention has a position of pilot gas, so, when the venting gas is not continuous, as for example, when the work is done with drilling equipment.

Therefore a burner (1) for venting gas of a gas or oil well is provided, the same comprises:

a venting gas tubing (2) laid from the well up to a burning pit (3);

a tubing for the supply of pilot gas (4) laid parallel to the tubing of venting gas (2);

a tubing of power lines (5) from a control panel up to at least one electrode (6);

a nozzle (7) constituted by a tube (8) that comprises:

a plurality of perforations (9) that go through the wall of said tube (8), a plurality of air inlet tubes (10) affixed to the wall of said tube (8); and a plurality of support spoilers (11) affixed to the wall of said tube (8);

where, the distal ends of the venting gas tubing (2), the tubing of supply of pilot gas (4) and at the least one electrode (6), are located inside the nozzle (7); and where, the nozzle (7) is installed inside the burning pit (3).

In this manner, according to the operational circumstances in the well, the burner (1), according to the present invention may be combined, that is due to the fact that it work by means of the lighting of 'pilot gas or of the venting line (2) in a discretionary manner. It may also work a burner (1) lighted of pilot gas only or also as burner (1) lighted of venting gas exclusively.

The line of pilot gas (4) is used when the gas is eventual in drilling and complies with the function of allowing that the slug to burn in the burning pit (3). To such effect, a line (2) is laid next to the burner and corresponding to the venting of gas from the well being drilled. In drilling wells, but not production wells, the line of vent gas (12) is preferably external respecting the burner.

The internal line (2) to the burner, preferably of a diameter of 88.9 mm, may stem from a gas separator or a kicker of a test pool, as long as the well is for production or testing.

According to the present invention, the preferred materials employed in the construction of the burner (1) and accessory installations may be, for example, tube of 298.45 mm (11¾") diameter for the nozzle. Preferably, the casing of 298.45 is "42 lbs/ft-Schd 40", which means a net weight of 19.05 kg each 304.8 mm length of the tube with a thickness defined by the Cedula 40 classification.

On a regular basis, a tube of 88.9 mm (3½") diameter is used for the main tube of the venting line (2, 12), preferably being of the type "J55-9.2 lbs/ft", where J55 refers to the chemical compound of the material and its mechanical properties and "9.2 lbs/ft" refers to the net weight of 4.17 kg each 304.8 mm of the tube.

In other preferred embodiments, the venting line (2, 12) may have other diameters such as 101.6 mm (4"), 114.3 mm (4½"), 127.0 mm (5"), 139.7 (5½"), 152.4 mm (6") and 203.2 mm (8") depending on the volume of gas to be vented. In the same manner, the diameter of the nozzle (7) may vary from the burner (1), depending on the chosen venting line (2,12).

Furthermore, the nozzle (7) may include a variable number of spoilers (11), as well as the angle inclination of said spoilers may vary in order to facilitate the dissipation of heat and maintaining the structure of the nozzle (7).

Preferably, epoxy tube of 12.7 mm (½ ") diameter is employed for the line of pilot gas (4). As protective sheath of the ignition electrodes (6), epoxy tube of 31.75 mm (1¼") diameter are employed, which is the usual for gas.

Other materials that are also employed in a preferred form of the construction of the burner (1) of venting gas are copper cables for the transmission of electricity, electrical junction boxes (13) of (20×20×10) cm, stainless steel electrodes 316L (6) and ceramic insulators (14).

When is the case where between two proximal electrodes (6) there is a large difference in potential, a spark is created between the same. The lighting devices by means of an electrical spark are based in said property. As electrodes (6), a plug or an electrode (6) and the burner (1) itself may be used, furthermore, two electrodes (6).

Thus, the at least one electrode (6) of the burner (1) closes circuit with the venting gas tubing (2) or the tubing for the supply of grounded pilot gas (4).

Alternatively, the at least one electrode (6) closes circuit with another grounded electrode.

The electrodes (6) are insulated electronically from the metal parts of the burner (1) with ceramic insulators (14).

According to the type of circuit used to produce the necessary tension to provoke the spark to ignite, we can find tow types: by means of high frequency spark or by high voltage spark. The equipment will depend of the resources at hand at the proximity of the well: high and medium tension lines connected to transformers, low tension lines, electricity generators and battery banks.

Thus, the lighting of the burner (1) may be realized by means of high frequency spark or high tension spark.

The vent gas is then lit at a distance by means of a generator or accumulator equipment (15) that produces an electric arch (spark) by means of an electric current, such equipment being placed at a distance of 50 meters or more from the burning pit (3).

In a preferred way of embodiment of the burner (1) according to the present invention, the plurality of perforations (9) that go through the wall of the tube (8) of the nozzle (7) are arranged in four symmetrical lines.

Furthermore, the plurality of air inlet tubes (10) affixed to the wall of the tube (8) of the nozzle (7), in a preferred embodiment are four and are affixed at 45 degrees from the axis of the nozzle (7) in its proximal end. The function of said tubes (10) is to provoke air flow from outside the burner (1) to the inside by means of the passage of gas so as to favor the mixture for combustion and achieve ate the same time the cooling of the structure of the nozzle (7).

In the same manner, the plurality of support spoilers (11) affixed to the wall of the tube (8) of the nozzle (7) are affixed at 90 degree one to the other alternate and symmetrical with respect to the perforations (9).

NUMERICAL REFERENCES OF THE VENTING BURNER a burner (1) for vent gas of a oil or gas well
a tubing for venting gas (2)
a burning pit (3)
a tubing for the supply of pilot gas (4)
a tubing of electric lines (5)
an electrode (6)
a nozzle (7)
a tube (8) (of nozzle (7))
a plurality of perforations (9) that go through the wall of said tube (8);
a plurality de of air inlet tubes (10)
a plurality of support spoilers (11)
a line (of venting gas) (12) next to the burner
electrical junction boxes (13) of (20×20×10) cm
ceramic insulators (14)
a generator or accumulator equipment (15) that produces an electrical arch (spark) by means of an electrical current

The invention claimed is:

1. A burner for venting gas of a gas or oil well, characterized in that the same comprises:

a venting gas tubing laid from the well up to a burning pit;
a tubing for the supply of pilot gas laid parallel to the tubing of venting gas;
a tubing of power lines from a control panel up to at least one electrode;
a nozzle constituted by a tube that comprises:
a plurality of perforations that go through the wall of said tube,
a plurality of air inlet tubes affixed to the wall of said tube; and
a plurality of support spoilers affixed to the wall of said tube;
where, the distal ends of the venting gas tubing, the tubing of supply of pilot gas and at the least one electrode, are located inside the nozzle; and
where, the nozzle is installed inside the burning pit.

2. The burner in accordance to claim 1, wherein the at least one electrode closes circuit with the venting gas tubing or the tubing that supplies pilot gas, grounded.

3. The burner in accordance to claim 1, wherein the at least one electrode closes circuit with another grounded electrode.

4. The burner in accordance to claim 1, wherein the electrodes are isolated from the metallic parts of the burner with ceramic.

5. The burner in accordance to claim 1, wherein the lighting of the burner is carried out by means of high frequency spark or high voltage spark.

6. The burner in accordance to claim 1, wherein the plurality of perforations that go through the wall of the tube of the nozzle are arranged in four symmetrical lines.

7. The burner in accordance to claim 1, wherein the plurality of air inlet tubes affixed to the wall of the tube of the nozzle are four in number and are fixed at 45 degrees of the axis of the nozzle in its proximal end.

8. The burner in accordance to claim 1, wherein the plurality of support spoilers affixed externally and longitudinally to the wall of the tube of the nozzle, are fixed at 90 degrees with respect to said tube and in an alternate and symmetrical way in relation to said perforations.

9. The burner in accordance to claim 1, wherein the venting gas tubing internal to the burner that fits in the burning pit vents gas from a production or test well stemming from a gas separator or from a test pool kicker.

10. The burner in accordance to claim 1, wherein the burner counts with a venting line laid at the side of the burner and fitting in the burning pit venting gas from a well being drilled.

* * * * *